US010714908B1

(12) United States Patent
Gozawa et al.

(10) Patent No.: US 10,714,908 B1
(45) Date of Patent: Jul. 14, 2020

(54) SPARK PLUG

(71) Applicant: NGK Spark Plug Co., Ltd., Nagoya-shi, Aichi (JP)

(72) Inventors: Tatsuya Gozawa, Nagoya (JP); Kenji Ban, Nagoya (JP)

(73) Assignee: NGK Spark Plug Co., Ltd., Nagoya-shi (JP)

( * ) Notice: Subject to any disclaimer, the term of this patent is extended or adjusted under 35 U.S.C. 154(b) by 0 days.

(21) Appl. No.: 16/843,977

(22) Filed: Apr. 9, 2020

(30) Foreign Application Priority Data

Apr. 16, 2019 (JP) ..... 2019-077488

(51) Int. Cl.

| | |
|---|---|
| ***H01T 13/06*** | (2006.01) |
| ***H01T 21/02*** | (2006.01) |
| ***H01T 13/32*** | (2006.01) |
| ***H01T 13/39*** | (2006.01) |
| ***H01T 13/08*** | (2006.01) |

(52) U.S. Cl.
CPC ..... *H01T 21/02* (2013.01); *H01T 13/06* (2013.01); *H01T 13/08* (2013.01); *H01T 13/32* (2013.01); *H01T 13/39* (2013.01)

(58) Field of Classification Search
CPC ..... H01T 13/06
USPC ..... 313/141
See application file for complete search history.

(56) References Cited

U.S. PATENT DOCUMENTS

| | | | | |
|---|---|---|---|---|
| 2013/0055986 | A1* | 3/2013 | Tozzi | F02P 13/00 123/254 |
| 2013/0206122 | A1* | 8/2013 | Chiera | F02P 15/001 123/594 |
| 2016/0053671 | A1* | 2/2016 | Sotiropoulou | F02B 19/18 123/260 |
| 2016/0276810 | A1* | 9/2016 | Chiera | F02B 19/12 |

FOREIGN PATENT DOCUMENTS

JP 2006-144648 A 6/2006

* cited by examiner

*Primary Examiner* — Christopher M Raabe
(74) *Attorney, Agent, or Firm* — Kusner & Jaffe

(57) ABSTRACT

A spark plug includes a center electrode; a metal shell that retains the center electrode at an outer periphery of the center electrode in an insulating manner; a ground electrode disposed such that a spark gap is formed between the center electrode and an end portion of the ground electrode; and a plug cap connected to the metal shell, the plug cap covering the center electrode and the end portion of the ground electrode from front and having a through hole in a region in front of the ground electrode. An inner surface of the plug cap has at least one ridge in a first region that is in front of an inner open end of the through hole.

4 Claims, 5 Drawing Sheets

SPARK PLUG

FIELD OF THE INVENTION

The present invention relates to a spark plug including a pre-chamber for a combustion chamber of an engine.

BACKGROUND OF THE INVENTION

A spark plug including a pre-chamber for a combustion chamber of an engine is known. This type of spark plug includes a plug cap that is connected to a metal shell and that has a through hole. The plug cap is exposed in the combustion chamber so that the pre-chamber is provided in the combustion chamber. The spark plug ignites combustible air-fuel mixture that has flowed into the plug cap from the combustion chamber through the through hole. The combustible air-fuel mixture is combusted to generate an expansion pressure that causes a gas flow including flame to be injected into the combustion chamber through the through hole. The combustible air-fuel mixture in the combustion chamber is combusted by the injected flow of flame. Japanese Unexamined Patent Application Publication No. 2006-144648, hereinafter "patent document 1" (in particular, FIG. 26) discloses a spark plug including a plug cap having an inner surface on which ridges are formed in a region behind through holes so that the cross-sectional area of the pre-chamber gradually increases toward the back.

However, according to the technology disclosed in patent document 1, when the combustible air-fuel mixture flows into the plug cap from the combustion chamber through the through holes, the plug cap, which is exposed in the combustion chamber, is cooled by the combustible air-fuel mixture. In particular, the temperature of a front portion of the plug cap becomes lower than the temperature of a back portion of the plug cap. As a result, the temperature of the combustible air-fuel mixture in a front region in the plug cap is reduced. Accordingly, in the region around the front end of the plug cap, the flame propagation velocity is reduced in accordance with the reduction in the temperature of the combustible air-fuel mixture. When the velocity of flame propagation from the inside of the plug cap toward the through holes is reduced, the combustion rate in the combustion chamber is adversely affected.

SUMMARY OF THE INVENTION

The present invention has been made to solve the above-described problem, and an object of the present invention is to provide a spark plug capable of increasing the velocity of flame propagation from an inside of a plug cap toward a through hole.

To achieve the above-described object, a spark plug according to the present invention includes a center electrode; a metal shell that retains the center electrode at an outer periphery of the center electrode in an insulating manner; a ground electrode disposed such that a spark gap is formed between the center electrode and an end portion of the ground electrode; and a plug cap connected to the metal shell, the plug cap covering the center electrode and the end portion of the ground electrode from front and having a through hole in a region in front of the ground electrode. An inner surface of the plug cap has at least one ridge in a first region that is in front of an inner open end of the through hole.

According to a spark plug of a first aspect, the inner surface of the plug cap includes the first region, in which at least one ridge is formed, in front of the inner open end of the through hole. Therefore, the flow of the combustible air-fuel mixture near the first region can be more strongly disrupted than when the first region has no ridges. The influence of the degree of disruption of the flow of the combustible air-fuel mixture on an increase in the flame propagation velocity is greater than the influence of the temperature of the combustible air-fuel mixture on the flame propagation velocity. Therefore, the flame propagation velocity can be increased despite the reduction in the temperature of the combustible air-fuel mixture. Thus, the velocity of flame propagation from the inside of the plug cap toward the through hole can be increased.

According to a spark plug of a second aspect, a size of the ridge is such that a length of the ridge in a circumferential direction of the inner surface is greater than a length of the ridge in an axial line direction of the inner surface. Therefore, a turbulent flow can be easily generated when the combustible air-fuel mixture that has flowed into the plug cap from the combustion chamber through the through hole flows along the first region in the axial line direction.

Therefore, not only can the effects of the first aspect be obtained, but the flame propagation velocity can be further increased.

According to a spark plug of a third aspect, the ridge is continuous over an entire circumference of the inner surface of the plug cap. Therefore, compared to when the ridge is provided in a portion of the entire circumference of the inner surface of the plug cap, the turbulent flow can be more easily generated. Accordingly, not only can the effects of the first and second aspects be obtained, but the flame propagation velocity can be further increased.

According to a spark plug of a fourth aspect, the inner surface of the plug cap additionally has the ridge in a second region that is in front of the ground electrode and behind the inner open end. Therefore, the turbulent flow can be easily generated when the combustible air-fuel mixture that has flowed into the plug cap from the combustion chamber through the through hole flows along the second region toward the back. In addition, the turbulent flow can also be easily generated when the gas flow including flame flows along the second region toward the front. Therefore, not only can the effects of the first to third aspects be obtained, but the flame propagation velocity can be further increased.

DETAILED DESCRIPTION OF THE INVENTION

Figure 1:
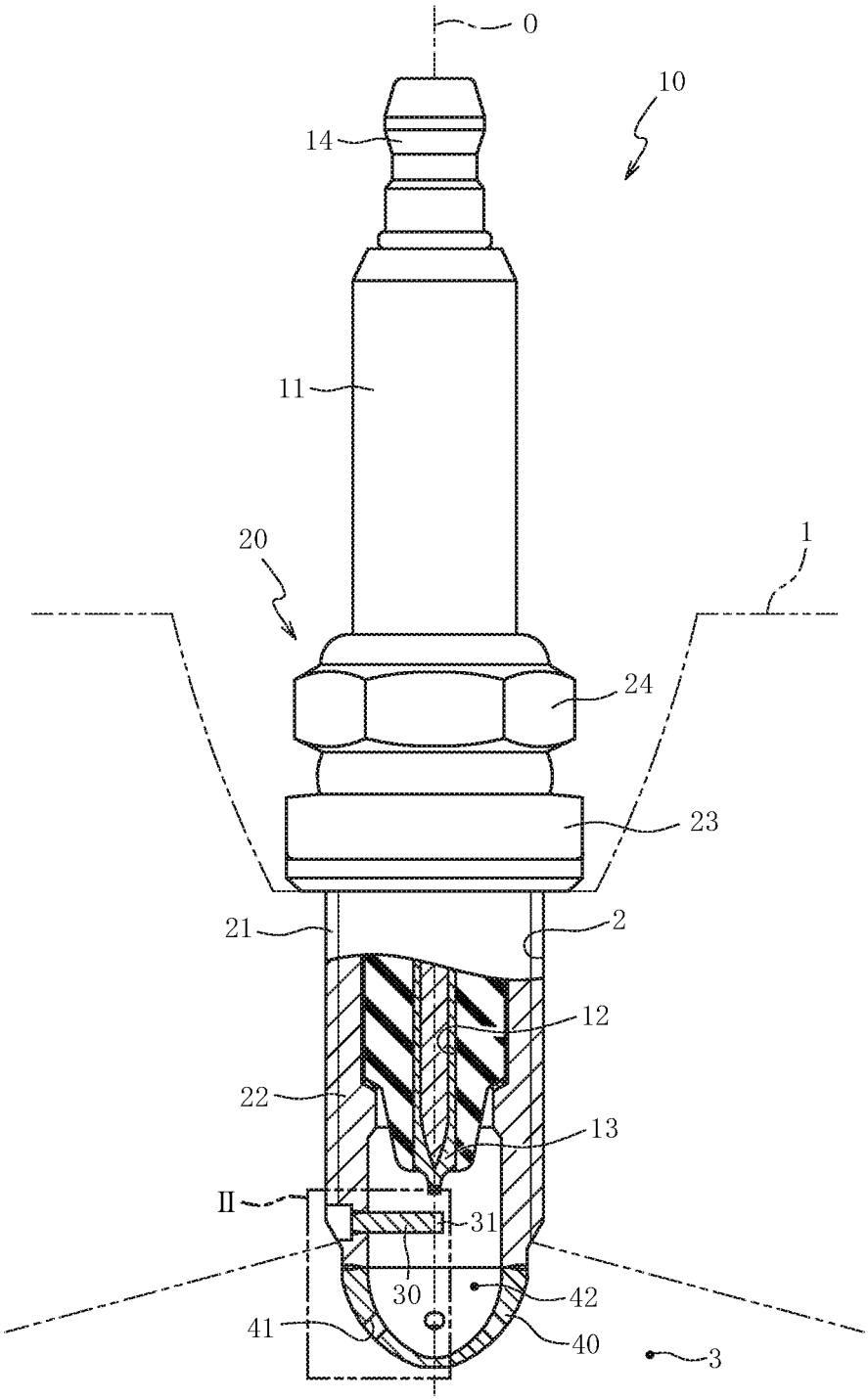
FIG. 1 is a partially sectioned view of a spark plug according to an embodiment.

Preferred embodiments of the present invention will now be described with reference to the accompanying drawings. FIG. 1 is a partially sectioned view of a spark plug 10 according to an embodiment. The bottom of FIG. 1 is defined as the front of the spark plug 10, and the top of FIG. 1 is defined as the back of the spark plug 10. This also applies to FIG. 2. FIG. 1 shows a cross section of a front end portion of the spark plug 10 including an axial line O. As illustrated in FIG. 1, the spark plug 10 includes an insulator 11, a center electrode 13, a metal shell 20, a ground electrode 30, and a plug cap 40.

The insulator 11 is a substantially cylindrical member having an axial hole 12 that extends along the axial line O, and is made of a ceramic, such as alumina, having good mechanical characteristics and high insulation properties at high temperatures. The center electrode 13 is disposed in a front region of the axial hole 12 in the insulator 11. The center electrode 13 is electrically connected to a metal terminal 14 in the axial hole 12. The metal terminal 14 is a rod-shaped member to which a high-voltage cable (not shown) is connected, and is made of a conductive metal material (for example, low-carbon steel). The metal terminal 14 is fixed to the back end of the insulator 11.

The metal shell 20 is a substantially cylindrical member made of a conductive metal material (for example, low-carbon steel). The metal shell 20 includes a front end portion 22 having an external thread 21 formed on an outer peripheral surface thereof, a seating portion 23 that is adjacent to and behind the front end portion 22, and a tool engagement portion 24 provided behind the seating portion 23. The external thread 21 is screwed into a threaded hole 2 in an engine 1. The seating portion 23 is a portion that seals a clearance between the threaded hole 2 in the engine 1 and the external thread 21, and has an outer diameter greater than the outer diameter of the external thread 21. The tool engagement portion 24 engages with a tool, such as a wrench, used to screw the external thread 21 into the threaded hole 2 in the engine 1.

The ground electrode 30 is a rod-shaped member made of a metal material containing, for example, Ni as a main component. In the present embodiment, the ground electrode 30 is disposed at a position where the external thread 21 is provided, and extends through the front end portion 22 to project into the inside of the front end portion 22. One end portion 31 of the ground electrode 30 faces the center electrode 13. The plug cap 40 is connected to the front end portion 22 of the metal shell 20.

The plug cap 40 is a portion that covers the center electrode 13 and the end portion 31 of the ground electrode 30 from the front. The plug cap 40 is made of a metal material containing, for example, Ni as a main component. The plug cap 40 has at least one through hole 41 in a region in front of the ground electrode 30. In the present embodiment, a plurality of through holes 41 are formed in the plug cap 40. When the spark plug 10 is installed by screwing the external thread 21 into the threaded hole 2 in the engine 1, the plug cap 40 is exposed in a combustion chamber 3 of the engine 1. The through holes 41 connect a pre-chamber 42, which is surrounded by the metal shell 20 and the plug cap 40, to the combustion chamber 3.

Figure 2:
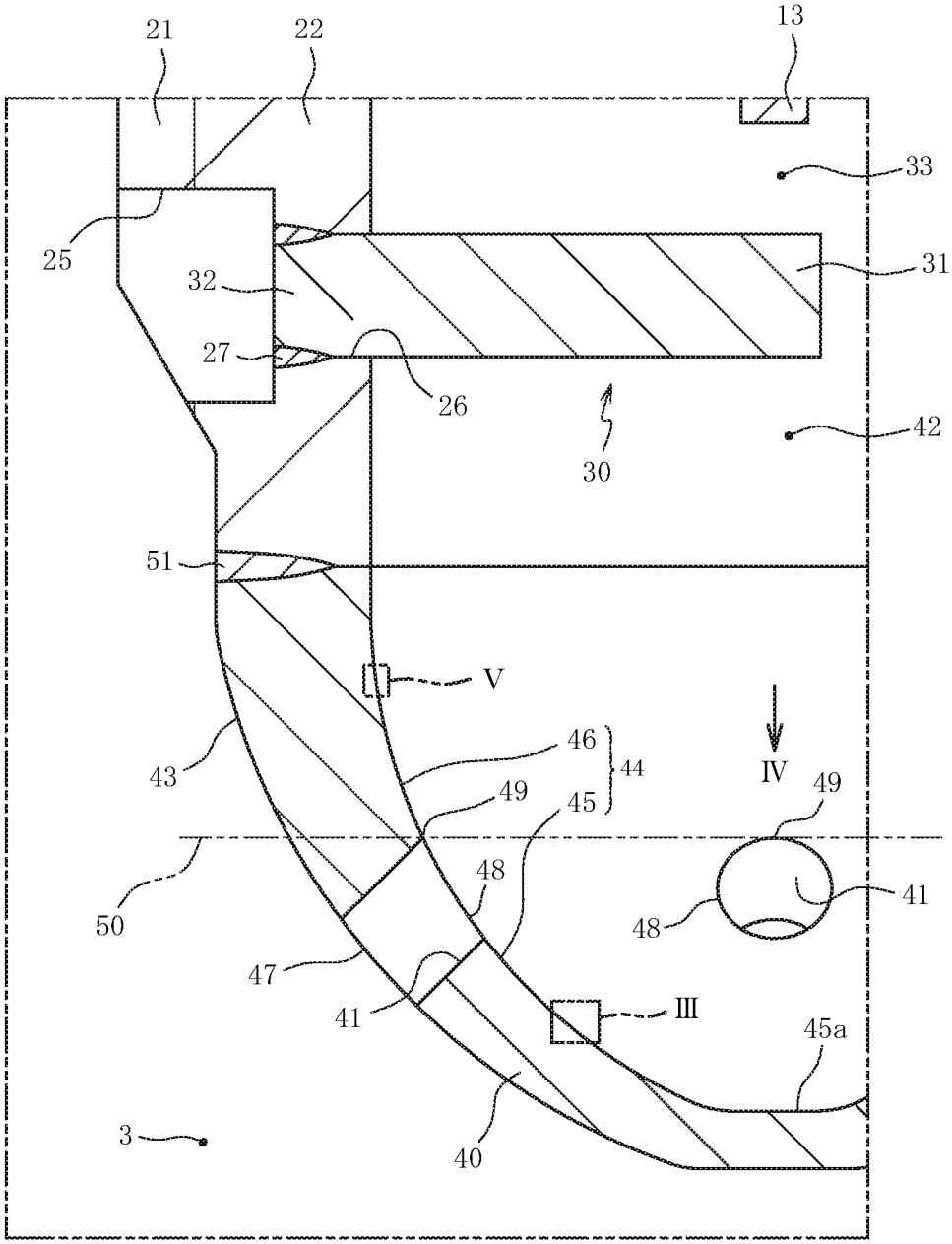
FIG. 2 is an enlarged sectional view of part II of the spark plug shown in FIG. 1.

FIG. 2 is an enlarged sectional view of part II of the spark plug 10 shown in FIG. 1 including the axial line O. The front end portion 22 of the metal shell 20 has a recess 25 that is recessed radially inward in a region where the external thread 21 is provided. The front end portion 22 also has a hole 26, which is thinner than the recess 25, in a region radially inside the recess 25. The hole 26 extends through the front end portion 22 in a radial direction. The other end portion 32 of the ground electrode 30 is inserted in the hole 26 and joined to the front end portion 22 by a welded portion 27. A spark gap 33 is formed between the end portion 31 of the ground electrode 30 and the center electrode 13. Since the ground electrode 30 is joined to the metal shell 20 in the region where the external thread 21 is provided, heat is transferred from the ground electrode 30 to the engine 1 through the external thread 21.

Each through hole 41 has an outer open end 47 in an outer surface 43 of the plug cap 40 and an inner open end 48 in an inner surface 44 of the plug cap 40. The inner open end 48 of each through hole 41 is positioned in front of the end portion 31 of the ground electrode 30. Each through hole 41 is inclined toward the front in the direction from the inner open end 48 to the outer open end 47 thereof. In the present embodiment, back ends 49 of the inner open ends 48 of the through holes 41 are all positioned on a plane 50 perpendicular to the axial line O. The plug cap 40 is joined to the front end portion 22 of the metal shell 20 by a welded portion 51.

The inner surface 44 of the plug cap 40 is sectioned into a first region 45 that is in front of the inner open ends 48 of the through holes 41 and a second region 46 that is behind the first region 45. The first region 45 is a portion of the inner surface 44 of the plug cap 40 that is in front of a cross section of the plug cap 40 taken along the plane 50. The second region 46 is a portion of the inner surface 44 of the plug cap 40 that is behind the cross section of the plug cap 40 taken along the plane 50. The first region 45 is spherical-cap-shaped, and the second region 46 is cylindrical or spherical-zone-shaped. The first region 45 includes a front end surface 45*a* that is circular and flat.

Figure 3:
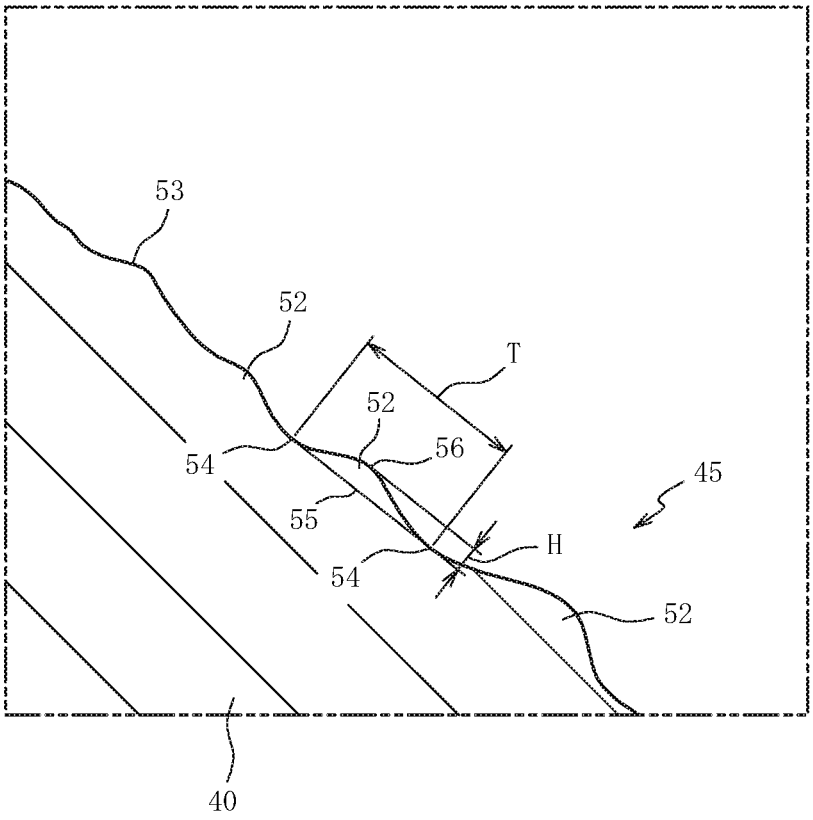
FIG. 3 is an enlarged sectional view of part III of the spark plug shown in FIG. 2.

FIG. 3 is an enlarged sectional view of part III of the spark plug 10 shown in FIG. 2. As illustrated in FIG. 3, the plug cap 40 includes at least one ridge 52 in the first region 45. In the present embodiment, a plurality of ridges 52 are provided in the first region 45.

Figure 4:
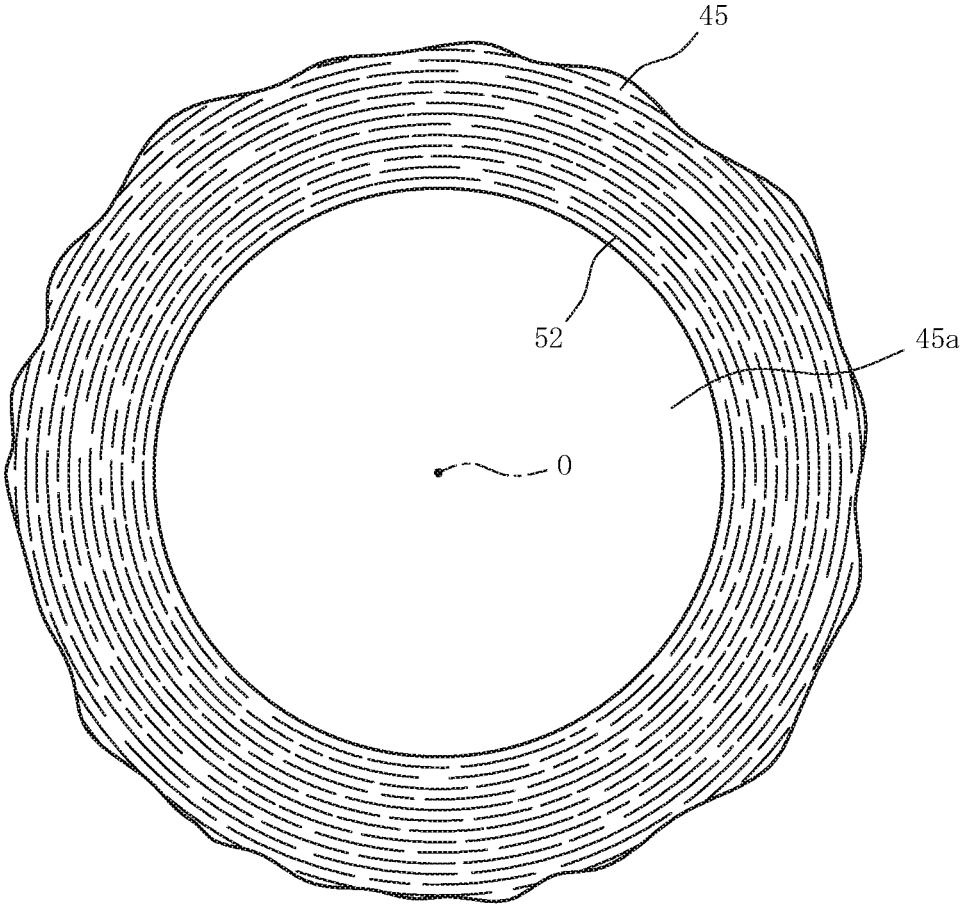
FIG. 4 is a schematic plan view of a first region viewed in the direction of arrow IV in FIG. 2.

FIG. 4 is a schematic plan view of the first region 45 viewed in the direction of arrow IV in FIG. 2. FIG. 4 illustrates a portion of the first region 45 around the front end surface 45*a* at the center, and a region around this portion is not illustrated. As illustrated in FIG. 4, the ridges 52 formed in the first region 45 are arranged in the portion the first region 45 around the front end surface 45*a*, and extend in a circumferential direction along the front end surface 45*a* having a circular shape. The size of each ridge 52 is such that the length of the ridge 52 in the circumferential direction of the first region 45 is greater than the length of the ridge 52 in the axial line direction of the first region 45. The first region 45 spreads in both the radial direction and the axial line direction. Therefore, the length of each ridge 52 in the axial line direction of the first region 45 can also be referred to as the length of each ridge 52 in the radial direction of the first region 45.

In the present embodiment, each ridge 52 has the shape of an arc having the axial line O at the center, and the ridges 52 are connected to each other in the circumferential direction so that the ridges 52 are continuous to each other over the entire circumference of the first region 45. However, FIG. 4 is a schematic diagram, and therefore does not illustrate portions of the arc-shaped ridges 52 that are connected to each other in the circumferential direction. The ridges 52 that are continuous to each other over the entire circumference of the first region 45 are arranged concentrically about the axial line O. The concentrically arranged ridges 52 are adjacent to each other in the radial direction of the first region 45. The ridges 52 are formed over the entire region of a portion of the first region 45 excluding the front end surface 45*a*.

Referring to FIG. 3 again, a profile curve 53 of the surface of the first region 45 extends radially inward (rightward in FIG. 3) with increasing distance toward the front (downward in FIG. 3). The profile curve 53 is a line of intersection between a plane including the axial line O (plane of FIG. 3) and the first region 45. It is not necessary that the entirety of the profile curve 53 be inclined radially inward with increasing distance toward the front. However, at least a portion of the profile curve 53 is inclined in this manner. The profile curve 53 is determined by, for example, detecting the surface properties of the first region 45 in accordance with JIS B0601:2013 by using an optical non-contact surface roughness measurement device and removing short-wavelength and long-wavelength components from the obtained curve by using a filter.

A height H and a length T of each ridge 52 can be determined from the profile curve 53. The height H of each ridge 52 is the distance between an apex 56 of the ridge 52 and a line segment 55 that connects adjacent roots 54 of the ridge 52 on the profile curve 53. The length T of the ridge 52 is the length of the line segment 55. The heights H and lengths T of the ridges 52 are set as appropriate. For example, the ridges 52 are formed so that the heights H thereof are in the range of 2 to 10 μm, and that the lengths T thereof are in the range of 10 to 50 μm. The heights H and the lengths T of the ridges 52 are preferably in these ranges because a gas flow in the radial direction (axial line direction) of the first region 45 can be more strongly disrupted.

Figure 5:
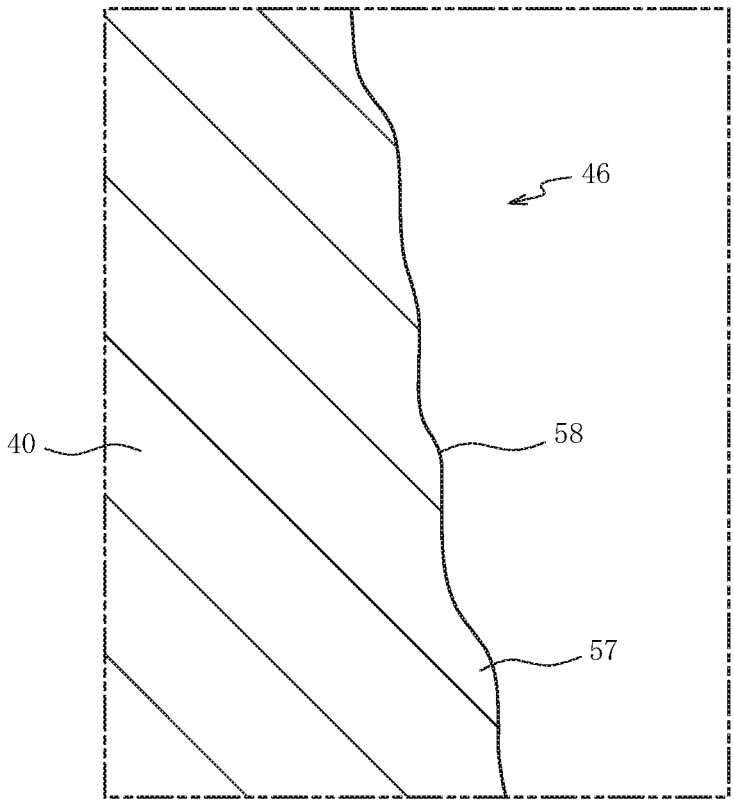
FIG. 5 is an enlarged sectional view of part V of the spark plug shown in FIG. 2.

FIG. 5 is an enlarged sectional view of part V of the spark plug 10 shown in FIG. 2. As illustrated in FIG. 5, the plug cap 40 also includes at least one ridge 57 that extend in the circumferential direction in the second region 46. In the present embodiment, a plurality of ridges 57 are provided in the second region 46. The size of each ridge 57 is such that the length of the ridge 57 in the circumferential direction of the second region 46 is greater than the length of the ridge 57 in the axial line direction of the second region 46.

In the present embodiment, each ridge 57 has the shape of an arc having the axial line O at the center, and the ridges 57 are connected to each other in the circumferential direction so that the ridges 57 are continuous to each other over the entire circumference of the second region 46. The ridges 57 that are continuous to each other over the entire circumference of the second region 46 are arranged concentrically about the axial line O. The concentrically arranged ridges 57 are adjacent to each other in the axial line direction of the second region 46. The ridges 57 are formed over the entirety of the second region 46.

A profile curve 58 of the surface of the second region 46 extends radially inward (rightward in FIG. 5) with increasing distance toward the front (downward in FIG. 5). The profile curve 58 is a line of intersection between a plane including the axial line O (plane of FIG. 5) and the second region 46. It is not necessary that the entirety of the profile curve 58 be inclined radially inward with increasing distance toward the front. However, at least a portion of the profile curve 58 is inclined in this manner. The profile curve 58 can be determined by a method similar to the method for determining the profile curve 53 of the first region 45.

Similar to the ridges 52 in the first region 45, heights H and lengths T (not shown) of the ridges 57, which are determined from the profile curve 58, are set as appropriate. For example, the ridges 57 are formed so that the heights H thereof are in the range of 2 to 10 μm, and that the lengths T thereof are in the range of 10 to 50 μm. The heights H and the lengths T of the ridges 57 are preferably in these ranges because a gas flow in the axial line direction of the second region 46 can be more strongly disrupted.

The ridges 52 and 57 can be formed when, for example, a workpiece from which the plug cap 40 is formed is rotated together with a main shaft of a lathe or the like and when a cutting tool placed on a reciprocating table is brought into contact with the workpiece and moved in left-right and front-back directions to form the inner surface 44 of the plug cap 40 by a cutting process. The ridges 52 and 57 are formed such that the center thereof is on the axis of rotation of the main shaft. No ridges 52 are formed on the front end surface 45*a*, which perpendicularly intersects the axis of rotation of the main shaft. The lengths of the ridges 52 and 57 in the axial line direction and the circumferential direction can be adjusted based on the speed at which the cutting tool is moved. After the ridges 52 and 57 are formed on the inner surface 44 of the plug cap 40, the through holes 41 are formed in the plug cap 40 by, for example, a cutting process.

The cutting process using a cutting tool is an example of a method for forming the ridges 52 and 57, and the ridges 52 and 57 may, of course, be formed by another method. An example of another method is laser processing in which the inner surface 44 of the plug cap 40 is irradiated with a laser beam while assist gas is blown thereagainst to remove melted part. Alternatively, the plug cap 40 on which the ridges 52 and 57 are formed may be manufactured by powder metallurgy.

In response to a valve operation of the engine 1 (see FIG. 1), combustible air-fuel mixture flows into the plug cap 40 of the spark plug 10, which is attached to the engine 1, from the combustion chamber 3 through the through holes 41. The flow of the combustible air-fuel mixture that has entered the plug cap 40 is a turbulent flow. The spark plug 10 causes a discharge between the center electrode 13 and the ground electrode 30 to create a flame kernel in the spark gap 33. When the flame kernel grows, the combustible air-fuel mixture in the plug cap 40 is ignited and combusted. The combustion generates an expansion pressure so that the spark plug 10 injects a gas flow including flame into the combustion chamber 3 through each through hole 41. The combustible air-fuel mixture in the combustion chamber 3 is combusted by the injected flow of flame.

When the combustible air-fuel mixture flows into the plug cap 40 from the combustion chamber 3 through the through holes 41, the plug cap 40, which is exposed in the combustion chamber 3, is cooled by the combustible air-fuel mixture. Accordingly, the temperature of a front portion of the plug cap 40 becomes lower than the temperature of a back portion of the plug cap 40, which is positioned near the insulator 11 that serves as a heat source. As a result, the temperature of the combustible air-fuel mixture in a front region in the plug cap 40 is reduced. Accordingly, in the region in the plug cap 40 around the front end, the flame propagation velocity may be reduced in accordance with the reduction in the temperature of the combustible air-fuel mixture.

However, since the inner surface 44 of the plug cap 40 includes the first region 45, in which at least one ridge 52 is formed, in front of the inner open ends 48 of the through holes 41, when the combustible air-fuel mixture flows along the first region 45, the flow of the combustible air-fuel mixture can be more strongly disrupted than when the first region 45 has no ridges. The flow of the combustible air-fuel mixture is disrupted by the first region 45 both when the combustible air-fuel mixture flows into the plug cap 40 and when the combustible air-fuel mixture flows out of the plug cap 40. The influence of the degree of disruption of the flow of the combustible air-fuel mixture on an increase in the flame propagation velocity is greater than the influence of the temperature of the combustible air-fuel mixture on the flame propagation velocity. Therefore, the flame propagation velocity can be increased despite the reduction in the temperature of the combustible air-fuel mixture. Thus, the velocity of flame propagation from the inside of the plug cap 40 toward the through holes 41 can be increased. As a result, the combustible air-fuel mixture in the combustion chamber 3 can be rapidly combusted.

The size of each ridge 52 of the spark plug 10 is such that the length of the ridge 52 in the circumferential direction of the inner surface 44 is greater than the length of the ridge 52 in the axial line direction of the inner surface 44. Therefore, the combustible air-fuel mixture that has flowed into the plug cap 40 from the combustion chamber 3 through the through holes 41 is more likely to come into contact with the ridges 52 when the combustible air-fuel mixture flows along the first region 45 in the axial line direction (radial direction), and the turbulent flow can be easily generated. Accordingly, the flame propagation velocity can be further increased.

The ridges 52 are continuous over the entire circumference of the inner surface 44 of the plug cap 40. Therefore, compared to when the ridges are provided in a portion of the entire circumference of the inner surface 44 of the plug cap 40, the combustible air-fuel mixture is more likely to come into contact with the ridges 52 when the combustible air-fuel mixture flows along the first region 45 in the axial line direction (radial direction), and the turbulent flow can be more easily generated. Accordingly, the flame propagation velocity can be further increased.

The inner surface 44 of the plug cap 40 additionally includes the ridges 57 in the second region 46, which is in front of the ground electrode 30 and behind the inner open ends 48. Therefore, the turbulent flow can be easily generated also when the combustible air-fuel mixture that has flowed into the plug cap 40 from the combustion chamber 3 through the through holes 41 flows along the second region 46 toward the back. In addition, the turbulent flow can also be easily generated when the gas flow including flame flows along the second region 46 toward the front. Therefore, the flame propagation velocity can be further increased due to the ridges 57 behind the inner open ends 48.

Although the present invention has been described based on an embodiment, the present invention is not limited to the above-described embodiment in any way, and it can be easily understood that various improvements and modifications are possible within the spirit of the present invention. For example, the shape of the plug cap 40, the number, shapes, sizes, etc., of the through holes 41, and the heights H and lengths T of the ridges 52 and 57 are merely examples, and may be set as appropriate.

Although the plug cap 40 is welded to the metal shell 20 in the embodiment, the plug cap is not necessarily limited to this. For example, the plug cap may, of course, be a front end portion of a tubular member having a closed front end and connected to the front end portion 22 of the metal shell 20. The tubular member is disposed to surround the outer periphery of the front end portion 22 of the metal shell 20. An external thread formed on the outer peripheral surface of the tubular member is screwed into the threaded hole 2 in the engine 1.

The tubular member (plug cap) may be connected to the front end portion 22 of the metal shell 20 by, for example, forming an internal thread on an inner peripheral surface of the tubular member and screwing the internal thread onto the external thread 21 formed on the front end portion 22. Alternatively, a back end portion of the tubular member and the seating portion 23 of the metal shell 20 may be joined together by, for example, welding. Alternatively, a flange may be formed on the back end portion of the tubular member, and the seating portion 23 of the metal shell 20 and the flange may be joined together by, for example, welding. The tubular member may be made of, for example, a metal material, such as a nickel-based alloy, or a ceramic, such as silicon nitride.

Although the ground electrode 30 that extends through the front end portion 22 of the metal shell 20 is disposed at a position where the external thread 21 is provided in the embodiment, the position of the ground electrode is not necessarily limited to this. For example, the plug cap may be disposed such that the front end surface of the front end portion 22 of the metal shell 20 is exposed, and the ground electrode may, of course, be connected to the front end surface of the front end portion 22. The ground electrode may have either a straight shape or a bent shape. The ground electrode may be joined to the plug cap.

Although the inner open ends 48 of the through holes 41 appear in a cross section of the plug cap 40 along a plane including the axial line O in the embodiment, the through holes are not necessarily limited to this. The through holes may, of course, be formed in the plug cap 40 such that positions of the inner open ends thereof relative to the axial line O are shifted so that the inner open ends do not appear in a cross section along a plane including the axial line O. In such a case, the positions of the inner open ends of the through holes can be determined based on the inner open ends that appear in a cross section of the plug cap 40 along a plane parallel to the axial line O. The first region 45 and the second region 46 are determined based on the determined positions of the inner open ends of the through holes.

In the embodiment, one end portion 31 of the ground electrode 30 is disposed in front of the center electrode 13 so that the spark gap 33 is formed in front of the center electrode 13. However, the spark gap 33 is not necessarily limited to this. For example, one end portion 31 of the ground electrode 30 may, of course, be disposed to be spaced from a side surface of the center electrode 13 so that the spark gap 33 is formed between the side surface of the center electrode 13 and the end portion 31 of the ground electrode 30. In addition, a plurality of ground electrodes 30 may, of course, be provided to form a plurality of spark gaps 33.

In the embodiment, the back ends 49 of the inner open ends 48 of the through holes 41 are all positioned on the plane 50 perpendicular to the axial line O. In other words, the back ends 49 of the inner open ends 48 are at the same position in the axial line direction. However, the arrangement of the back ends 49 is not necessarily limited to this. The back ends 49 of the inner open ends 48 may, of course, be at different positions in the axial line direction. When the back ends 49 of the inner open ends 48 are at different positions in the axial line direction, the first region 45 is a portion of the inner surface 44 of the plug cap 40 that is in front of a cross section of the plug cap 40 taken along a plane that is perpendicular to the axial line O and that passes through one of the back ends 49 of the inner open ends 48 that is closest to the back end of the spark plug 10. The second region 46 is a portion of the inner surface 44 of the plug cap 40 that is behind the first region 45.

In the embodiment, the ridges 52 are formed over the entire region of a portion of the first region 45 excluding the front end surface 45*a*, and the ridges 57 are formed over the entirety of the second region 46. However, the ridges 52 and 57 are not necessarily limited to this. The ridges 52 may, of course, be formed in part of the first region 45 including the front end surface 45*a*, and the ridges 57 may, of course, be formed in part of the second region 46.

In the embodiment, the ridges 52 and 57 each have the shape of an arc having the axial line O at the center, and the ridges 52 and 57 are connected to each other in the circumferential direction so that the ridges 52 are continuous to each other over the entire circumference of the first region 45 and that the ridges 57 are continuous to each other over the entire circumference of the second region 46. However, the ridges 52 and 57 are not necessarily limited to this. For example, the ridges 52 and 57 may, of course, be provided in portions of the circumference of the inner surface 44 of the plug cap 40, or be formed in a helical (spiral) shape.

When the ridges 52 and 57 are formed by a cutting process, the ridges 52 and 57 may be formed in a helical shape by slowly rotating the workpiece together with the main shaft and slowly moving the cutting tool in left-right and front-back directions while pressing the cutting tool against the workpiece. A single ridge 52 may be provided when the ridge 52 has a helical shape and extends continuously in the first region 45. A single ridge 57 may be provided when the ridge 57 has a helical shape and extends continuously in the second region 46. A plurality of helical ridges 52 may, of course, be provided in the first region 45, and a plurality of helical ridges 57 may, of course, be provided in the second region 46. When a plurality of helical ridges 52 and a plurality of helical ridges 57 are provided, the helical ridges 52 and 57 may be arranged in multiple helix patterns or be arranged next to each other in the axial line direction.

Although the ridges 57 are formed in the second region 46 in the embodiment, the second region 46 is not necessarily limited to this. The second region 46 may, of course, have no ridges 57.

What is claimed is:

1. A spark plug comprising:

a center electrode;

a metal shell that retains the center electrode at an outer periphery of the center electrode in an insulating manner;

a ground electrode disposed such that a spark gap is formed between the center electrode and an end portion of the ground electrode; and a plug cap connected to the metal shell, the plug cap covering the center electrode and the end portion of the ground electrode from front and having a through hole in a region in front of the ground electrode, wherein an inner surface of the plug cap has at least one ridge in a first region that is in front of an inner open end of the through hole.

2. The spark plug according to claim 1, wherein a size of the ridge is such that a length of the ridge in a circumferential direction of the inner surface is greater than a length of the ridge in an axial line direction of the inner surface.

3. The spark plug according to claim 1, wherein the ridge is continuous over an entire circumference of the inner surface.

4. The spark plug according to claim 1, wherein the inner surface of the plug cap additionally has the ridge in a second region that is in front of the ground electrode and behind the inner open end.

* * * * *